United States Patent [19]

Rodriguez

[11] Patent Number: 5,039,981

[45] Date of Patent: Aug. 13, 1991

[54] ELECTROMAGNETIC SECURITY DETECTORS

[76] Inventor: Joe S. Rodriguez, 2207 S. Griffith Ave., Owensboro, Ky. 42301

[21] Appl. No.: 419,724

[22] Filed: Oct. 11, 1989

[51] Int. Cl.[5] ..... G08B 13/24

[52] U.S. Cl. ..... 340/551; 324/228

[58] Field of Search ..... 340/551; 324/228, 227, 324/326, 239, 243, 261; 109/2-9; 128/734, 737, 846, 882

[56] References Cited

U.S. PATENT DOCUMENTS

| | | | |
|---|---|---|---|
| 3,924,546 | 12/1975 | Pretini | 109/3 |
| 3,971,983 | 7/1976 | Jaquet | 324/227 |
| 4,122,783 | 10/1978 | Pretini | 109/3 |
| 4,586,441 | 5/1986 | Zekich | 109/6 X |
| 4,656,954 | 4/1987 | Tonali | 109/6 |

*Primary Examiner*—Glen R. Swann, III
*Assistant Examiner*—Thomas J. Mullen, Jr.
*Attorney, Agent, or Firm*—Laurence R. Brown

[57] ABSTRACT

This invention provides improved structure and detection methods for electromagnetic field ferromagnetic security detection stations of the type conventionally used at airports and the like. Improved sensitivity to ferromagnetic masses, such as knives or firearms carried by a person in the vicinity of the feet, ankles or lower legs is achieved by interosing a riser platform to assure that the person is introduced into the detection electromagnetic field above the floor or ground plane a predetermined distance that increases sensitivity of the detection of ferromagnetic msses carried by the person in the lower leg portion of the body. Even greter improvement in detectability is afforded by the requirement that the person stand in place at a position in the detection field affording more sensitive detection. The invention is simply used to retrofit field stations by introduction of a riser platform.

4 Claims, 1 Drawing Sheet

ELECTROMAGNETIC SECURITY DETECTORS

TECHNICAL FIELD

This invention relates to electromagnetic metal detectors, specifically it to improvements in detection stations through which persons pass the invention which reduces false alarms and improves the probability of detection of ferromagnetic objects carried by such persons.

BACKGROUND ART

Electromagnetic metatl detector stations for finding ferromagnetic objects such as weapons carried by person into airports and other secured areas are well known in the art. Typically U.S. Pat. No. 3,971,983 July 27, 1976 to J. R. Jaquet provides such a system with the advantage that it is a passive system which works in different locations having different configuations of the earth's magnetic field.

In operation however, this and similar electromagnetic detectors have been found to produce false alarms particulary when sensitivity is set high enough to detect weapons etc. of small mass and/or to decrease the risks of passing weapons through undetected. Such false alarms cause relatively long delays in processing persons quickly through to board a flight, and tend to cause compromise sensitivity operation permitting weapons to be passed through a station escaping detection.

Furthermore even if sensitivity is high enough to detect a weapon while tolerating increased alarms, there is a possibility that a weapon will not be detected by prior art detection stations under certain conditions because of local variations in electromagnetic field configurations in different installations. The modification of such local electromagnetic configurations by local or environment personnel can permit shielding of weapons carried by a person through the detector station.

It is therefore the objective of this invention to improve the reliability of weapon detection in electromagnetic field metal detector stations, and to improve signal to noise ratios in detecting ferromagnetic objects of small mass.

Other objects, features and advantages of the invention will be found throughout the following description, claims and drawings.

DISCLOSURE OF THE INVENTION

This invention provides a metal detector station configuration and accompanying detection method which resolves the foregoing problems of the prior art.

The detection station structure and accordingly the electromagnatic field pattern which a person passess through is modified to produce more uniform performance with increased sensitivity to detection of weapons such as guns or knives.

This is accompanied by a detection procedural requirement for stopping a person at a most sensitive "sweet spot" on the trip through the detector station to produce more uniform performance and increased sensitivity.

These structural and procedural modifications are simplified and tailored in one embodiment for retrofit of existing detector stations in the field.

BRIEF DESCRIPTION OF THE DRAWINGS

Throughout the drawings, similar reference characters refer to comparable features to facilitate comparison, and the showing in the respective views is summarized, as follows.

THE PREFERRED EMBODIMENT

Figure 1:
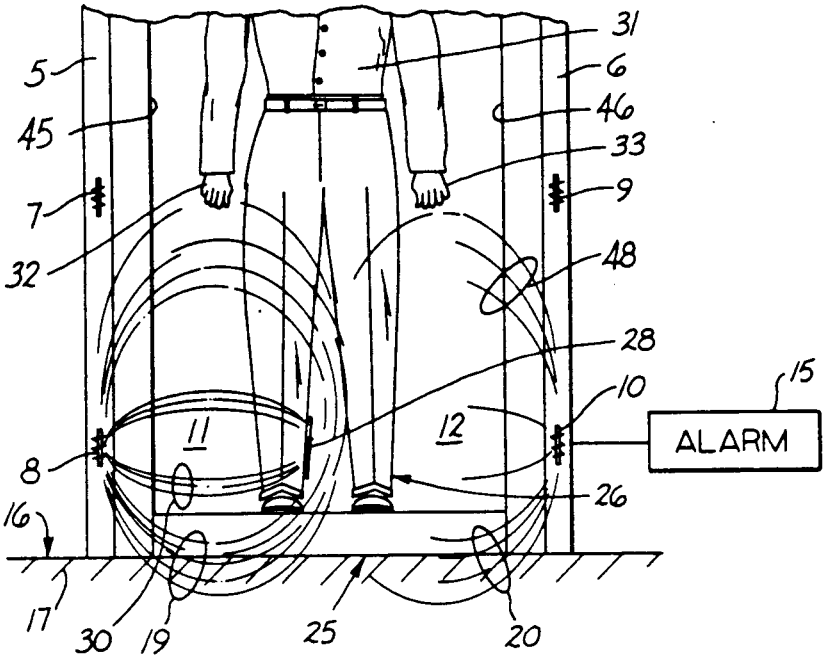
FIG. 1 is a diagrammatic sketch of a critical portion of an electromagnetic field ferromagnetic detector station for "frisking" persons to see if they are concealing weapons.

Before referring to the drawings, some background understanding of the operating conditions of detector stations will illustrate the manner in which this invention recognizes and solves critical operating problems, previously unrecognized in the art.

Electromagnetic field ferromagnetic detector stations are well known at airports, government facilities and industrial sites for screening or frisking visitors for possible concealed ferromagnetic weapons, i.e. knives or firearms. I have found that the signal to noise ratio (the ability to set the sensitivity level high enough to detect small ferromagnetic masses without introducing an unacceptable number of false alarms from extraneous noises) varies with the site environment of these installations. Thus, uniform detection procedures cannot be established with identical equipment. Even worse, there can be such low sensitivity that it is relatively easy to smuggle weapons past the detector station or to miss detection of other ferromagnetic masses that should produce an alarm.

The conditions under which these detectors operate defy electromagnetic field analysis theory, such as set forth in "Electromagnetics", Robert M. Whitner, Prentice-Hall, 1952. There are so many variations of the way persons walk, their size, what objects they carry that may disturb the detector local electromagnetic radiation including radar, electric charges in ionized air or persons bodies, ferromagnetic and conductor objects including motors, etc. that it is virtually impossible to isolate noise sources and produce more uniform reaction in diverse locations or to analyze operations theoretically. It is also impractical to limit use to sanitized locations, since the stations practically need to be at ramp, plant or building entrance locations, etc.

Because of attempts to develop weapons that escape detection, higher sensitivities are required, for example, being able to detect ferrous masses of 250 grams or less. This again causes noise problems from shoelace tips, hairpins and other legitimate objects commonly carried by persons being monitored.

A further essential feature of any improvement is that it must be retrofittable to existing field installations or usable for portable installations to prevent rapid obsolescence and adoption of newly introduced unproven models, which may even require retaining of operators who adjust and operate the detectors.

Thus, it has been indeed a complex task to analyze the comprehensive nature of the problem and to find simple and immediate solutions.

By analysis of those marginally detected weapons or ferrous masses, such as ferrous braces in shoes, it is found that the most susceptible region of the electromagnetic field detector systems for smuggling or cheating the system is in the lower leg portion of the body.

Careful analysis of the different systems also shows that the detection sensitivity of this region varies considerably at different locations.

Thus, we may turn to the lower portion of a detector station as sketched in FIG. 1 for a showing of the operational features improved by this invention. In the outer posts 5, 6, have upper and lower elements 7 to 10 producing separate electromagnetic fields 11 and 12 positioned in the right and left passageway regions viewed. Representative magnetic pattern lines are sketched only for the lower pair of elements 8, 10. Three or more vertically adjoining regions typically may be used to isolate ferromagnetic masses with different detectors to show positions of detected weapons (and to avoid accumulation of a detected mass of ferromagnetic metal distributed legitimately about the body as hairpins, etc.).

The alarm 15 is coupled to detect those variations of the generally static and passive field pattern caused by ferromagnetic metal masses passing through the field. The alarm may be adjusted for variable sensitivity and delay for eliminating noise spikes caused by short impulses found particularly about industrial environments.

The station is positioned on a surface 16 shown by hatching 17 to represent a ground plane, such as a cement floor or the earth. Carpets, flooring and other bases unless carefully prepared, exhibit some of the characteristics of a ground plane, of which the most important is the tendency to concentrate the magnetic field pattern near the bottom of the access passageway as indicated by the magnetic line bundles 19, 20. In the upper detector passageway regions 11, 12 *thereabove* the magnetic lines are more sparsely concentrated.

The operation structure and method of this invention uses this operational characteristic to produce more uniform and higher sensitivity performance of electromagnetic field detectors.

Thus, a riser platform 25 (FIGS. 2, 3) is inserted at the bottom of the detection passageway to raise the feet, ankles and lower leg portions 26 of a person being monitored into a more sensitive region or "sweet spot" of the detector passageway.

Consider the effect of this. If a knife blade (28) is carried at the ankle or in the shoe, it is positioned in a weaker static electromagnetic field as compared with that provided due to the influence of the ground plane without the riser 25. Note the effect of knife 28 to concentrate the field lines in the left region 11, as indicated by bundle 30. That produces a detectable alarm, which could have been missed as a minor variation or noise level signal if closer to the ground plane field bundle 19.

Figure 3:
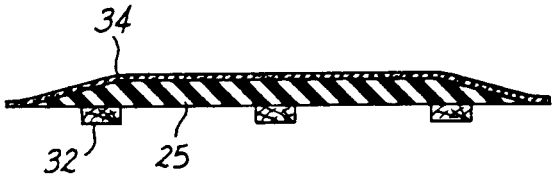
FIG. 3 is a side view of a riser platform provided to retrofit existing field detector stations for operation in accordance with this invention.

The platform riser 25 is critical in construction and thus is hatched in FIG. 3 as of rubber or electric insulator construction with ledges (32) providing air gaps, and a replaceable rubber carpet (34) preferably covering the riser. Alternatively the body could be a plywood frame *without nails.*

Figure 2:
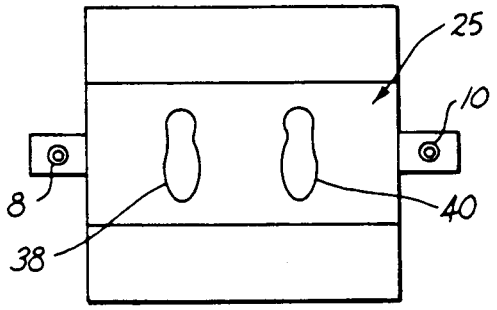
FIG. 2 is a top view sketch of the detector station of FIG. 1.

The height of the riser is typically three inches at the detector position indicated at the treads 38, 40 in FIG. 2.

It has been found in operation that this structure significantly increases signal strength from a small ferromagnetic metal mass (28). So much in fact that lower sensitivity settings can now detect weapons that escaped in the noise level with higher detection sensitivity setting without the riser 25. A weaker electromagnetic at a reduced sensitivity setting field 11, 12 is thus proportionately changed a greater degree by weapon 28 than in a stronger field, to give improved detection, and to unexpectedly at the same time improve the false alarm conditions.

Even greater detection capabilities are achieved by a change in the usual operating procedures of the detector stations where a person walks through. A skilled adversary can use quick or slow motions to mask weapons in the noise signals under certain circumstances in a walk through. Thus, the treads 38, 40 of FIG. 2 are used to place feet apart to avoid body mass (including conductive ions in blood etc. affecting the magnetic field as noise) to two legs close together from masking the weapon 28. The hands 32, 33 are held at the side in the weaker field pattern, giving greater sensitivity to small ferromagnetic bodies. Also the treads are positioned so that an optimum view of the lower body (feet, ankles and lower legs) is presented in the weaker and thus most sensitive "sweet spot" portion of the detector field. The alarm or detection is then initiated with the person (31) at rest, as a matter of procedure enforced by a resident operator well known at airport locations.

Further improvements against other possible evasive actions are achieved by spacing the outer walls 45, 46 of the detection passageway inwardly from the posts in order to remove the concentrated field areas typified by bundle 48 from the passageway and prevent masking a knife, for example, held in the palm and moved aganist the outer wall to prevent a large difference in the field pattern bundle 48.

It is clear that this invention provides an unexpected and simple improvement which greatly enhances detection sensitivity and signal to noise ratios in electromagnetic field ferromagnetic metal detectors by confining the pathway of a person through the detection field pattern to a sparsely concentrated field pattern region thereby preventing the masking of ferromagnetic metal objects by movement through more concentrated field regions produced in the electromagnetic detectors.

Having advanced the state of the art, those features of novelty believed descriptive of the nature and spirit of the invention are set forth with particularity in the following claims.

I claim:

1. The method of improving signal to noise ratio in electromagnetic field metal detector stations, comprising the steps of:

establishing an electromagnetic field pattern in the vicinity of the legs of a person passing through a detector station having means for detecting ferromagnetic masses in response to deflections of the electromagnetic field pattern by such masses carried by the person into said field, establishing a platform for positioning a person passing through the detection station at least a predetermined height above a ground plane that tends to concentrate the field of said electromagnetic field and into a region of a more sparsely concentrated electromagnetic field that is monitored by said detector, stopping motion of the person through the detector station at a position where the more sparsely concentrated electromagnetic field surrounds the persons feet, ankles and lower legs, and measuring the deflection of the latter said field caused by the presence of the person and objects carried by the person into the latter said field, whereby increased deflection of the electromagnetic field pattern results from a ferromagnetic mass in the vicinity of the legs of a person passing through the detector station.

2. The method of improving performance of an electromagnetic field metal security detector station for monitoring persons passing therethrough for detecting the presence of ferromagnetic masses, comprising the steps of:

establishing an electromagnetic detection field at a position to monitor the feet, ankles and lower legs of a person passing through the detection field, superimposing between the electromagnetic field and a ground plane upon which the detector station is positioned a platform restricting the positioning of the feet of a person in the field a predetermined distance above the ground plane that will assure improved detection of ferromagnetic objects in the vicinity of the feet, ankles and legs of the person when passing through the field, and stopping a person at a position with the legs stationary in said electromagnetic field when monitoring the field for detection of ferromagnetic masses.

3. An accessory for retrofitting an electromagnetic ferromagnetic detector station assembly for higher sensitivity to ferromagnetic masses carried by a person into the field at a position near the feet, ankles or lower legs comprising in combination, a riser platform for positioning the feet of a person passing through the station a predetermined distance above the level of the surface upon which the detector station resides that increases the sensitivity of the detector to said masses and having positioned on the platform structural indicia markers identifying a position where a person should stand to place the feet, ankles and lower legs within the electromagnetic field of the detector station at a higher sensitivity region.

4. The method of increasing the ferromagnetic detection sensitivity within generated electromagnetic field patterns through which persons pass that may be carrying ferromagnetic masses to be detected comprising the step of confining a pathway of the person through the field pattern that prevents positioning substantial portions of the person's body close to concentrated electromagnetic field regions produced in marginal portions of the field patterns.

* * * * *